US005905344A

United States Patent [19]

Vrionis

[11] Patent Number: 5,905,344

[45] Date of Patent: May 18, 1999

[54] DISCHARGE LAMPS AND METHODS FOR MAKING DISCHARGE LAMPS

[75] Inventor: Nickolas G. Vrionis, Los Altos, Calif.

[73] Assignee: Diablo Research Corporation, Sunnyvale, Calif.

[ * ] Notice: This patent is subject to a terminal disclaimer.

[21] Appl. No.: 08/660,781

[22] Filed: Jun. 5, 1996

Related U.S. Application Data

[63] Continuation of application No. 08/417,430, Apr. 4, 1995, Pat. No. 5,581,157, which is a continuation of application No. 08/272,884, Jul. 17, 1994, abandoned, which is a continuation of application No. 07/883,971, May 20, 1992, abandoned.

[51] Int. Cl.[6] ..... H01J 65/04

[52] U.S. Cl. ..... 315/248; 315/344

[58] Field of Search ..... 315/248, 267, 315/344, 117; 313/160, 161, 493, 634

[56] References Cited

U.S. PATENT DOCUMENTS

| | | | |
|---|---|---|---|
| 3,227,923 | 1/1966 | Morrison et al. | 315/248 |
| 3,309,565 | 3/1967 | Clark et al. | 315/117 |
| 3,500,118 | 3/1970 | Anderson | 315/57 |
| 3,521,120 | 7/1970 | Anderson | 315/57 |
| 3,987,334 | 10/1976 | Anderson | 315/57 |
| 3,987,335 | 10/1976 | Anderson | 315/62 |
| 4,010,400 | 3/1977 | Hollister | 315/248 |
| 4,017,764 | 4/1977 | Anderson | 315/248 |
| 4,024,431 | 5/1977 | Young | 315/248 |
| 4,048,541 | 9/1977 | Adams et al. | 315/248 |
| 4,117,378 | 9/1978 | Glascock, Jr. | 315/248 |
| 4,119,889 | 10/1978 | Hollister | 315/248 |
| 4,166,234 | 8/1979 | Tak et al. | 313/486 |
| 4,171,503 | 10/1979 | Kwon | 315/248 |
| 4,178,534 | 12/1979 | McNeill et al. | 315/39 |
| 4,206,387 | 6/1980 | Kramer et al. | 315/248 |
| 4,240,010 | 12/1980 | Buhrer | 315/248 |
| 4,245,178 | 1/1981 | Justice | 315/248 |
| 4,245,179 | 1/1981 | Buhrer | 315/248 |
| 4,253,047 | 2/1981 | Walker et al. | 315/248 |
| 4,254,363 | 3/1981 | Walsh | 315/248 |
| 4,260,931 | 4/1981 | Wesselink et al. | 313/493 |
| 4,376,912 | 3/1983 | Jernakoff | 315/248 |
| 4,383,203 | 5/1983 | Stanley | 315/248 |
| 4,390,813 | 6/1983 | Stanley | 315/248 |
| 4,422,017 | 12/1983 | Denneman et al. | 315/248 |
| 4,518,895 | 5/1985 | Lehman | 315/117 |
| 4,529,912 | 7/1985 | Northrup et al. | 315/117 |
| 4,536,675 | 8/1985 | Postma | 313/96 |
| 4,546,284 | 10/1985 | Renardius et al. | 313/44 |
| 4,568,859 | 2/1986 | Houkes et al. | 315/248 |
| 4,622,495 | 11/1986 | Smeelen | 315/248 |
| 4,625,152 | 11/1986 | Nakai | 315/317 |
| 4,645,967 | 2/1987 | Bouman et al. | 315/248 |
| 4,661,746 | 4/1987 | Postma et al. | 315/248 |
| 4,675,577 | 6/1987 | Hanlet | 315/428 |
| 4,694,215 | 9/1987 | Hofmann | 313/493 X |
| 4,704,562 | 11/1987 | Postma et al. | 315/248 |
| 4,710,678 | 12/1987 | Houkes et al. | 315/39 |
| 4,727,294 | 2/1988 | Houkes et al. | 313/248 |
| 4,727,295 | 2/1988 | Postma et al. | 315/248 |
| 4,728,867 | 3/1988 | Postma et al. | 315/248 |
| 4,792,727 | 12/1988 | Godyak | 315/176 |
| 4,797,595 | 1/1989 | DeJong | 313/493 |
| 4,812,702 | 3/1989 | Anderson | 313/153 |
| 4,864,194 | 9/1989 | Kobayashi et al. | 315/248 |
| 4,894,590 | 1/1990 | Witting | 315/248 |
| 4,922,157 | 5/1990 | Van Engen et al. | 315/248 |
| 4,927,217 | 5/1990 | Kroes et al. | 315/248 |
| 4,940,923 | 7/1990 | Kroontje et al. | 315/248 |
| 4,952,844 | 8/1990 | Godyak | 315/205 |
| 4,962,334 | 10/1990 | Godyak | 313/619 |
| 4,977,354 | 12/1990 | Bergervoet | 315/248 |
| 4,987,342 | 1/1991 | Godyak | 315/49 |
| 5,006,752 | 4/1991 | Eggink et al. | 313/161 |
| 5,006,763 | 4/1991 | Anderson | 315/248 |
| 5,013,975 | 5/1991 | Ukegawa et al. | 315/248 |
| 5,013,976 | 5/1991 | Butler | 315/248 |
| 5,245,246 | 9/1993 | Boland et al. | 313/44 X |
| 5,581,157 | 12/1996 | Vrionis | 313/493 X |

FOREIGN PATENT DOCUMENTS

| | | | |
|---|---|---|---|
| 4378 | 1/1978 | Japan | 315/248 |
| 28460 | 3/1981 | Japan | 315/248 |
| 61-232551 | 10/1986 | Japan | 313/45 |
| 710084 | 1/1980 | U.S.S.R. | 315/248 |

OTHER PUBLICATIONS

English translation of Japanese Patent Document No. 56–28460 dated Mar. 20, 1981.

Brochure—operating principles of the Philips QL lamp system entitled, "QL Induction Lighting", Philips Lighting B.V., 1991 (17 pages).

*Primary Examiner*—Benny T. Lee

*Attorney, Agent, or Firm*—Skjerven Morrill MacPherson Franklin & Friel LLP

[57] ABSTRACT

In some embodiments, a light bulb for an electrodeless discharge lamp has a protuberance such that the cold spot of the bulb is located in the protuberance. The protuberance is spaced from the induction coil of the lamp so as to be easily accessible. Hence the cold spot temperature is easy to measure and control. In some embodiments, heat sinks are provided to cool the light bulb. An active control element including a Peltier element is provided to control the cold spot temperature.

13 Claims, 11 Drawing Sheets

DISCHARGE LAMPS AND METHODS FOR MAKING DISCHARGE LAMPS

CROSS-REFERENCE TO RELATED APPLICATIONS

This application is a continuation of application Ser. No. 08/417,430, filed Apr. 4, 1995, now U.S. Pat. No. 5,581,157, which is a continuation of application Ser No. 08/272,884, filed Jul. 7,1994, now abandoned, which is a continuation of application Ser. No. 07/883,971, filed May 20, 1992, now abandoned.

This application is related to, and incorporates by reference, the following U.S. patent applications assigned to the assignee of the present application and filed on May 20, 1992: application Ser. No. 07/883,850, "Radio Frequency Interference Reduction Arrangements for Electrodeless Discharge Lamps", filed by Nicholas G. Vrionis and Roger Siao, now U.S. Pat. No. 5,397,966; application Ser. No. 07/887,165, "Electrodeless Discharge Lamp with Spectral Reflector and High Pass Filter", filed by Nicholas G. Vrionis, now abandoned; application Ser. No. 07/883,972, "Phosphor Protection Device for an Electrodeless Discharge Lamp", filed by Nicholas G. Vrionis and John F. Waymouth, now abandoned; application Ser. No. 08/068,846, "Base Mechanism to Attach an Electrodeless Discharge Light Bulb to a Socket in a Standard Lamp Harp Structure", filed by James W. Pfeiffer and Kenneth L. Blanchard, now abandoned; application Ser. No. 07/886,718, "Stable Power Supply in an Electrically Isolated System Providing a High Power Factor and Low Harmonic Distortion", filed by Roger Siao, now abandoned; application Ser. No. 07/887,168, "Class D Amplifiers" filed by Roger Siao, now U.S. Pat. No. 5,306,986; and application Ser. No. 07/887,166, "Filter and Matching Network", filed by Roger Siao, now abandoned.

BACKGROUND OF THE INVENTION

The invention relates to electric discharges, and more particularly to controlling the temperature of the medium in which the discharges take place.

The incandescent lamp is an often-used source of lighting in many homes and businesses. However, its light emitting element evaporates and becomes weak with use, and hence is easily fractured or dislodged from its supports. Thus, the lifetime of an incandescent lamp is short and unpredictable. More importantly, the efficiency of an incandescent lamp in converting electrical power to light is very low.

Discharge lamps, in which light is generated by an electric discharge in a gaseous medium, are generally more efficient and durable than incandescent lamps. See U.S. Pat. No. 4,010,400 issued Mar. 1, 1977 to Hollister.

As is known in the art, the efficiency of the discharge lamp depends on the temperature of the coldest spot ("the cold spot") of the gaseous medium. The discharge lamp efficiency reaches its maximum at a certain cold spot temperature Tm, between 30° C. and 40° C. for some lamps. See, for example, Netten and Verhiej, *OL Induction Lighting* (Philips Lighting B.V., 1991, printed in the Netherlands). Thus to maximize the efficiency, it is desirable to keep the cold spot temperature at the value Tm. However, the heat from the lamp can raise the cold spot temperature well above Tm. For example, in lamps with Th below 40° C., the heat can raise the cold spot temperature above 100° C. Thus there is a need for a discharge lamp in which the cold spot temperature can be controlled so as to be closer to the value Tm.

Further, it is desirable to be able to easily measure the cold spot temperature in order to determine what factors bring the cold spot temperature closer to value Tm.

SUMMARY OF THE INVENTION

The invention provides a discharge lamp in which the cold spot is easily accessible so that the cold spot temperature can be easily measured and controlled. In one embodiment, the light-bulb of the discharge lamp is provided with a protuberance which is spaced from the circuitry generating the electric discharge so as to be easily accessible. The cold spot is located in the protuberance. Since the protuberance is easily accessible, the cold spot temperature is easy to measure. The cold spot temperature is controlled by controlling the length of the protuberance because the cold spot temperature decreases as the protuberance length increases.

Methods for making light bulbs with protuberances according to the invention are also provided.

In some embodiments, a heat sink is provided at the protuberance so as to lower the cold spot temperature.

In some embodiments, heat sinks are provided at other portions of the light bulb in order to lower the cold spot temperature. Some embodiments include active temperature control elements, such as a Peltier element.

Other features of the invention, including other embodiments with and without the above-described protuberance, are described below. The invention is defined by the appended claims.

DESCRIPTION OF THE PREFERRED EMBODIMENTS

Figure 1:
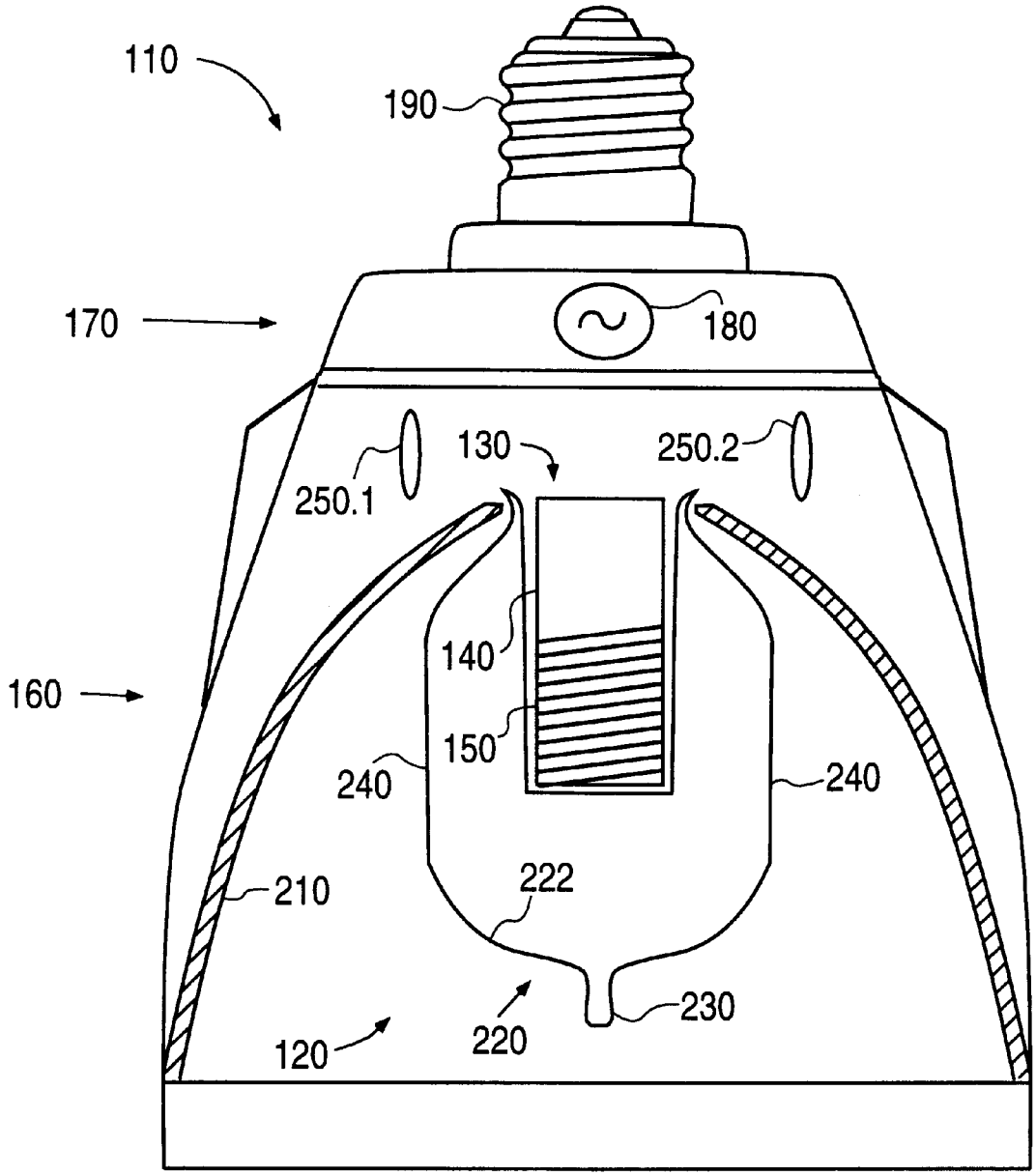
FIGS. 1 is a cross section of an electrodeless discharge lamp according to the invention.
Figure 2:
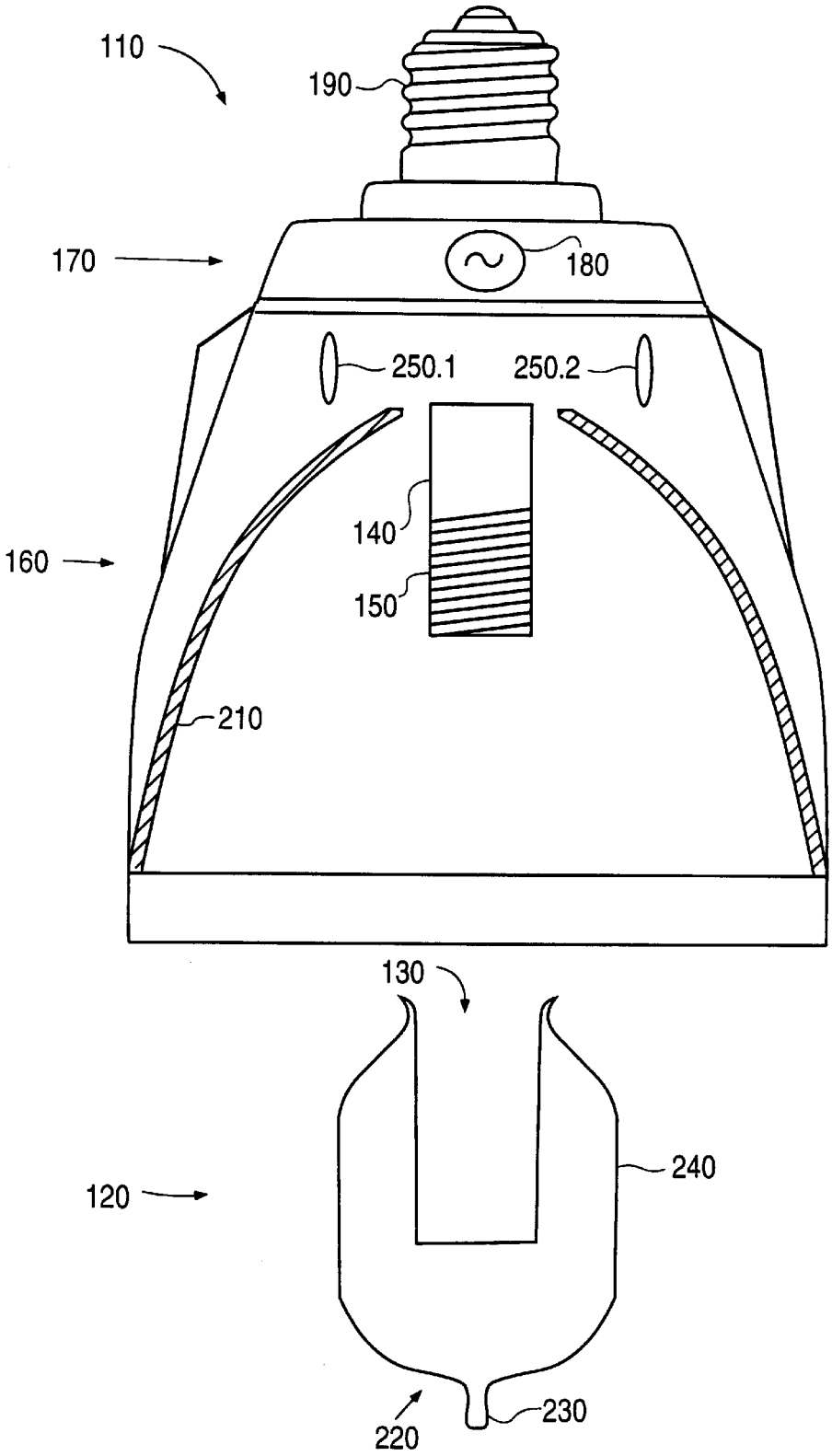
FIG. 2 is a cross section of the lamp of FIG. 1 with the light bulb shown removed from the lamp housing.

FIGS. 1 and 2 show a cross-section of an electrodeless fluorescent discharge lamp 110. Light bulb 120 includes an envelope charged with a mixture of a mercury vapor and a noble gas (one or more of helium, neon, argon, krypton, xenon, and radon). The envelope of light bulb 120 includes a cylindrical cavity 130 extending towards the inside of the envelope. Cavity 130 receives hollow cylindrical member 140 made of a non-conductive non-magnetic material such as kyton (Trademark) available from the Phillips Petroleum Company of Bartlesville, Okla. or ULTEM (Trademark) available from the General Electric Company of Sunnyvale, Calif. A plastic capable of withstanding high temperatures, a glass, or a ceramic can also be used. An induction coil 150 is wrapped around or deposited on the surface of cylindrical member 140. Cylindrical member 140 is attached to metal housing 160 whose base 170 houses a radio frequency power supply schematically shown at 180. Threaded portion 190 of base 170 fits into a conventional power socket (not shown) designed for incandescent light bulbs. Power supply 180 converts the 120 V-60 cycle alternating current from the socket into a high frequency alternating current of, for example, 2 MHz to 300 MHz, the frequency is 13.56 MHz in one embodiment. See U.S. Pat. No. 4,010,400 issued Mar. 1, 1977 to Hollister and incorporated herein by reference; Netten and Verhiej, *OL Induction Lighting* (Philips Lighting B.V., 1991, printed in the Netherlands) incorporated herein by reference. Lamp 110 includes also a reflector 210 fitted inside housing 160.

The envelope of light bulb 120 has a portion 220 whose outer surface faces away from cavity 130 and from cylindrical member 140. The inner surface 222 of portion 220 is coated by a phosphor (not shown), such as any of the standard halophosphates or fluorophosphates. When lamp 110 is turned on, the high frequency current passed by power supply 180 through coil 150 produces an electric field inside the envelope of light bulb 120. The electric field ionizes the noble gas in the envelope. The electrons stripped from the noble gas atoms and accelerated by the electric field collide with mercury atoms. Some mercury atoms become excited to a higher energy state without being ionized. As the excited mercury atoms fall back from the higher energy state, they emit photons, predominantly ultraviolet photons. These UV photons interact with the phosphor on the inner surface 222 to generate visible light. See *OL Induction Licthting*, supra, pages 5–6.

Figure 3:
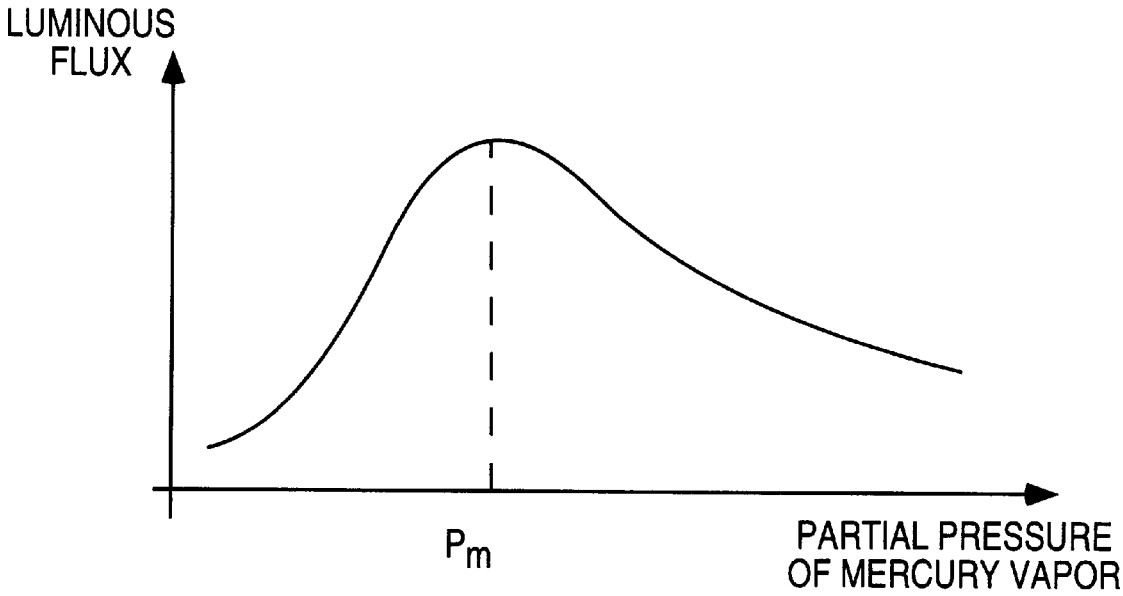
FIG. 3 is a graph showing the dependence of the luminous flux generated by an electrodeless discharge lamp on a partial mercury vapor pressure in the light bulb of the lamp.

The luminous flux generated by light bulb 120 depends on the mercury vapor partial pressure in the light bulb envelope as is illustrated by the graph of FIG. 3. The luminous flux reaches its maximum at a mercury pressure shown as Pm. The flux is smaller at a pressure lower than Pm because at the lower pressure fewer mercury atoms produce UV radiation. The flux is smaller at a pressure higher than Pm because at the higher pressure some mercury atoms collide with UV photons generated by other mercury atoms and these UV photons do not reach the phosphor-coated envelope surface 222 and do not generate visible light.

The mercury vapor pressure increases with the temperature of the coldest spot inside the envelope of light bulb 120 ("the cold spot"). The optimal cold spot temperature value Tm, at which the mercury pressure reaches the value Pm, is between 30° C. and 60° C. in some embodiments, between 38° C. and 40° C. in some examples. The value Pm is between 4 mtorr and 9 mtorr, 6 mtorr in one embodiment. The noble gas composition at temperature Tm in these embodiments is 60% neon, 40% argon by volume for a total noble gas pressure of 1 torr to 2 torr.

To increase the luminous flux, it is desirable to control the cold spot temperature so as to keep it at the value Tm or at least close to Tm. Further, it is desirable to be able to easily measure the cold spot temperature in order to determine what factors bring the cold spot temperature closer to the value Tm.

In order to facilitate the cold spot temperature control and measurement, the envelope of light bulb 120 in FIGS. 1 and 2 is provided with protuberance 230 on the envelope portion 220 at the opposite end from cavity 130. Protuberance 230 in one embodiments is a substantially cylindrical protuberance about 7 mm to 16 mm in length and about 6 mm to 8 mm in diameter. It has been experimentally determined that when lamp 110 is operated in the base-up position shown in FIGS. 1 and 2, the cold spot is located in protuberance 230. It appears possible that the cold spot is located in protuberance 230 if lamp 110 is operated in other positions.

The cold spot temperature is controlled by controlling the length of protuberance 230. It has been experimentally determined that the cold spot temperature is lowered more if protuberance 230 is longer. Hence protuberance 230 is made longer for higher wattage lamps since higher wattage lamps generate more heat. In some embodiments, the length of protuberance 230 is increased from 7 mm to 16 mm as the lamp wattage is increased from 19 W to 26 W.

In one embodiment, protuberance 230 has the length 7 mm and the diameter 68 mm, and the remainder of the envelope portion 220 has an approximately spherical shape of diameter 66.675 mm.

In some lamps which are operated in the base-down position, the cold spot temperature is lowered by making the lateral surface 240 of the envelope portion 220 to be substantially cylindrical (as shown in FIGS. 1 and 2) rather than spherical. The substantially cylindrical shape allows the hot air to rise easier away from the lamp. In one such embodiment, protuberance 230 has the length 7 mm and the diameter 6 mm to 8 mm. Envelope portion 220 has a spherical part above and below surface 240. The diameter of that part is 66.675 mm. Cylindrical surface 240 is about 60 mm in height. Surface 240 is symmetric with respect to the horizontal plane passing through the center of bulb 120.

Housing 160 is provided with slots such as slots 250.1 and 250.2 to conduct the hot air away from protuberance 230 as shown in FIGS 1,2.

Since protuberance 230 is easily accessible, the cold spot temperature is easy to measure using, for a example, a thermocouple connected to protuberance 230 on the outside of the bulb. The thermocouple converts the thermal energy at protuberance 230 into a voltage and determines the temperature from that voltage, as is known in the art. See, for example, R. F. Graf, *Modern Dictionary of Electronics* (6th Ed., Howard W. Sams & Company, 1984 , 4th printing 1989) incorporated herein by reference, at pages 1029–1030, under "thermocouple".

Light bulb 120 is manufactured as follows. Light bulb 120 is molded of glass essentially in the shape shown in FIGS. 1 and 2, but with a long open-ended tube at the location of protuberance 230. Through the tube, the air is pumped out of light bulb 120 to a desired pressure and the mercury and the noble gas are introduced into the light bulb in the desired quantities. The tube is then heated and cut off to a certain length to leave protuberance 230.

Figure 4:
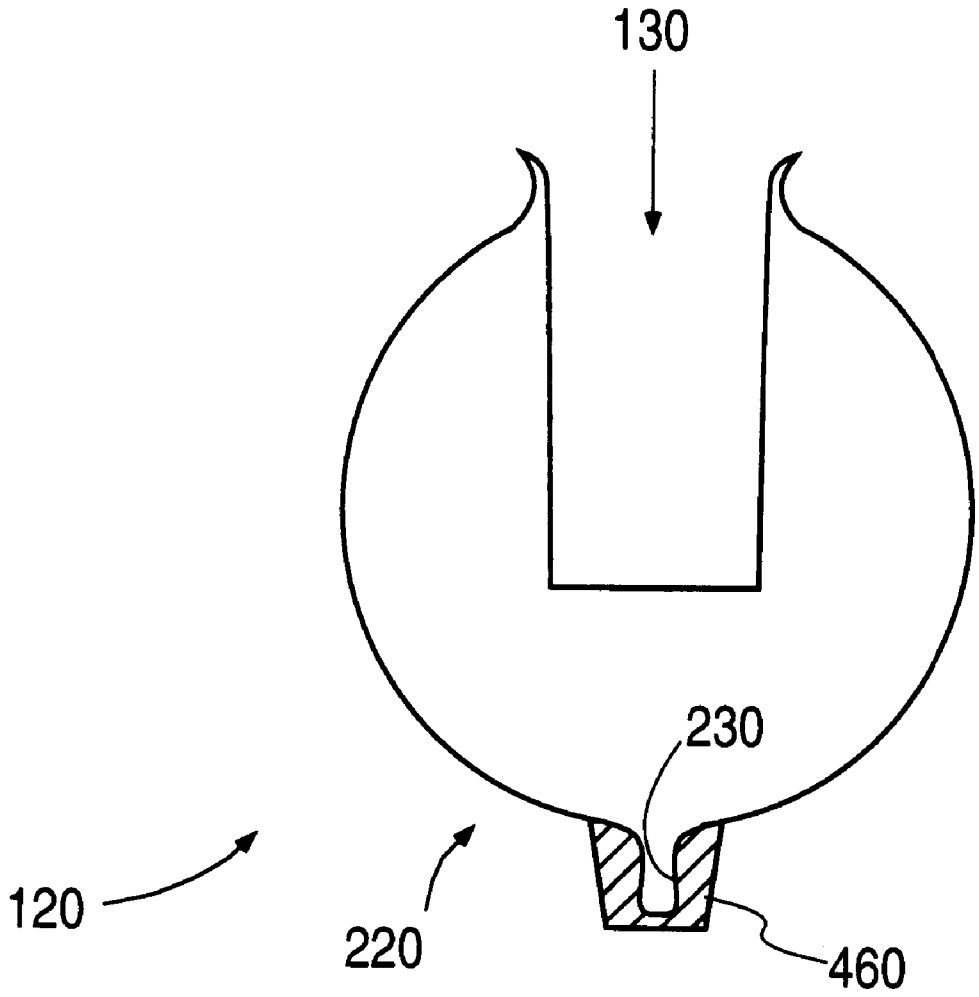
FIG. 4 is a cross section of a light bulb for an electrodeless discharge lamp according to the invention.

FIG. 4 shows light bulb 120, cavity 130, and envelope portion 220

In the embodiment of FIG. 4, in order to cool the cold spot, protuberance 230 is laterally contacted on all sides by a metal heat sink 460.

Figure 5:
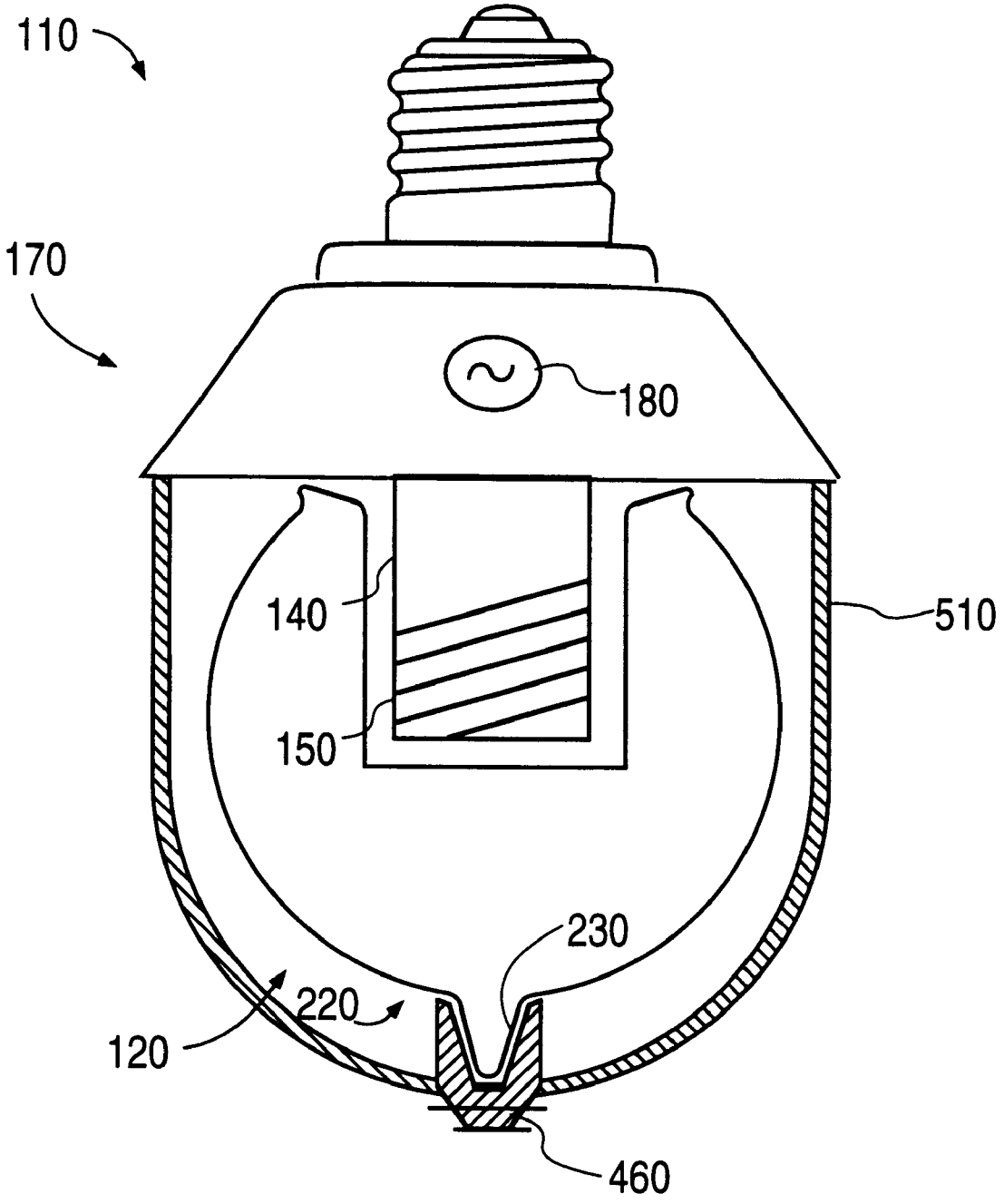
FIG. 5 is a cross section of an electrodeless discharge lamp according to the invention.

In FIG. 5, lamp 110 is provided, for RF shielding purposes, with an additional envelope 510 which surrounds light bulb 120. Envelope 510 is formed of plastic or glass. Envelope 510 contains a finely woven metal fabric (not shown) or an expanded metal (not shown) as described in the aforementioned patent application entitled "Radio Frequency Interference Reduction Arrangements for Electrodeless Discharge Lamps", Ser. No. 07/883,850, now U.S. Pat. No. 5,397,966 Metal heat sink 460 sits on protuberance 230 and passes outside envelope 510. FIG. 5 also shows cylindrical member 140, induction coil 150, and power supply 180.

In some embodiments of FIG. 5 protuberance 230 is on a side of envelope portion 220 rather than on the bottom of portion 220. Air vents (not shown) are provided in envelope 510 and/or in base 170 in order to cool the protuberance. In such embodiments, superior cooling of the protuberance is achieved in the base-down position of the lamp.

Figure 6:
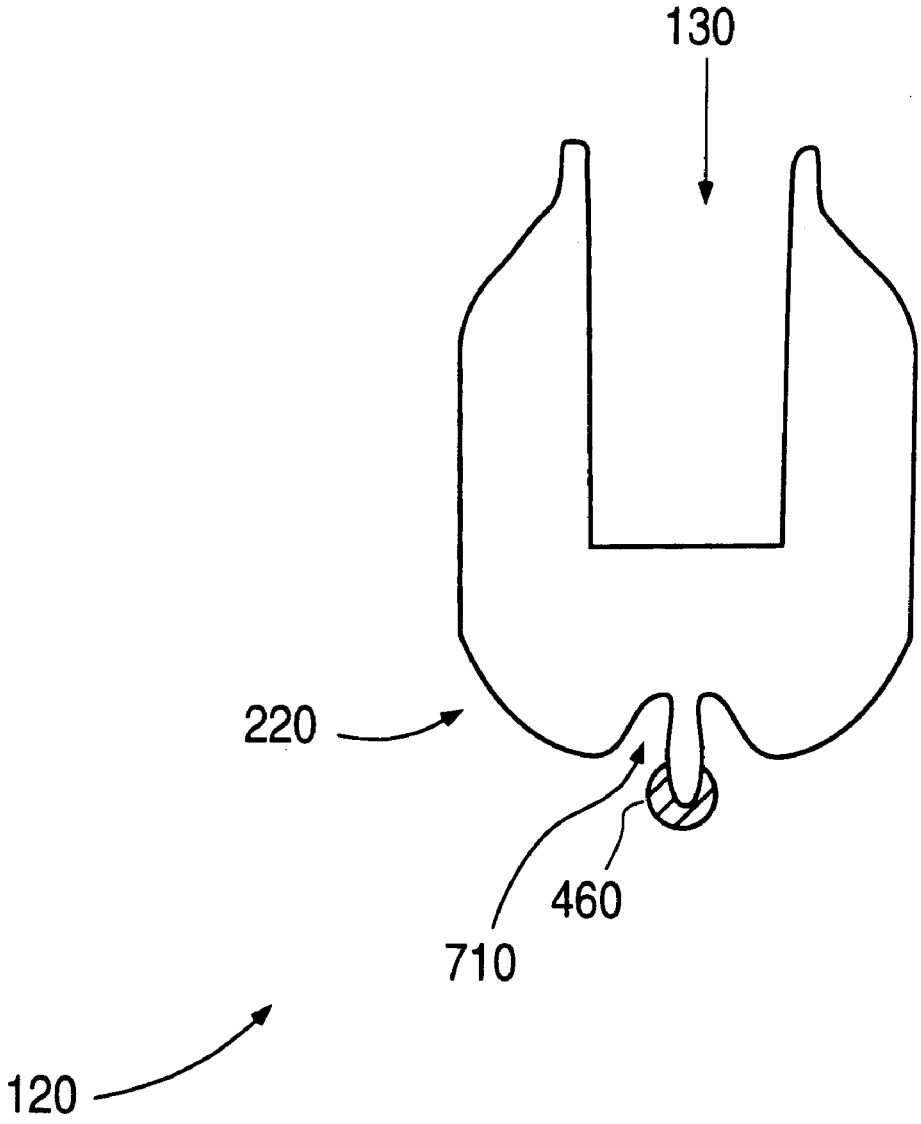
FIG. 6 is a cross section of a light bulb according to the invention.

In FIG. 6, light bulb 120 is provided with an additional cylindrical cavity 710 opposite cavity 130. Protuberance 230 is set in the middle of cavity 710. Metal heat sink 460 surrounds protuberance 230. FIG. 6 also shows envelope portion 220.

Figure 7:
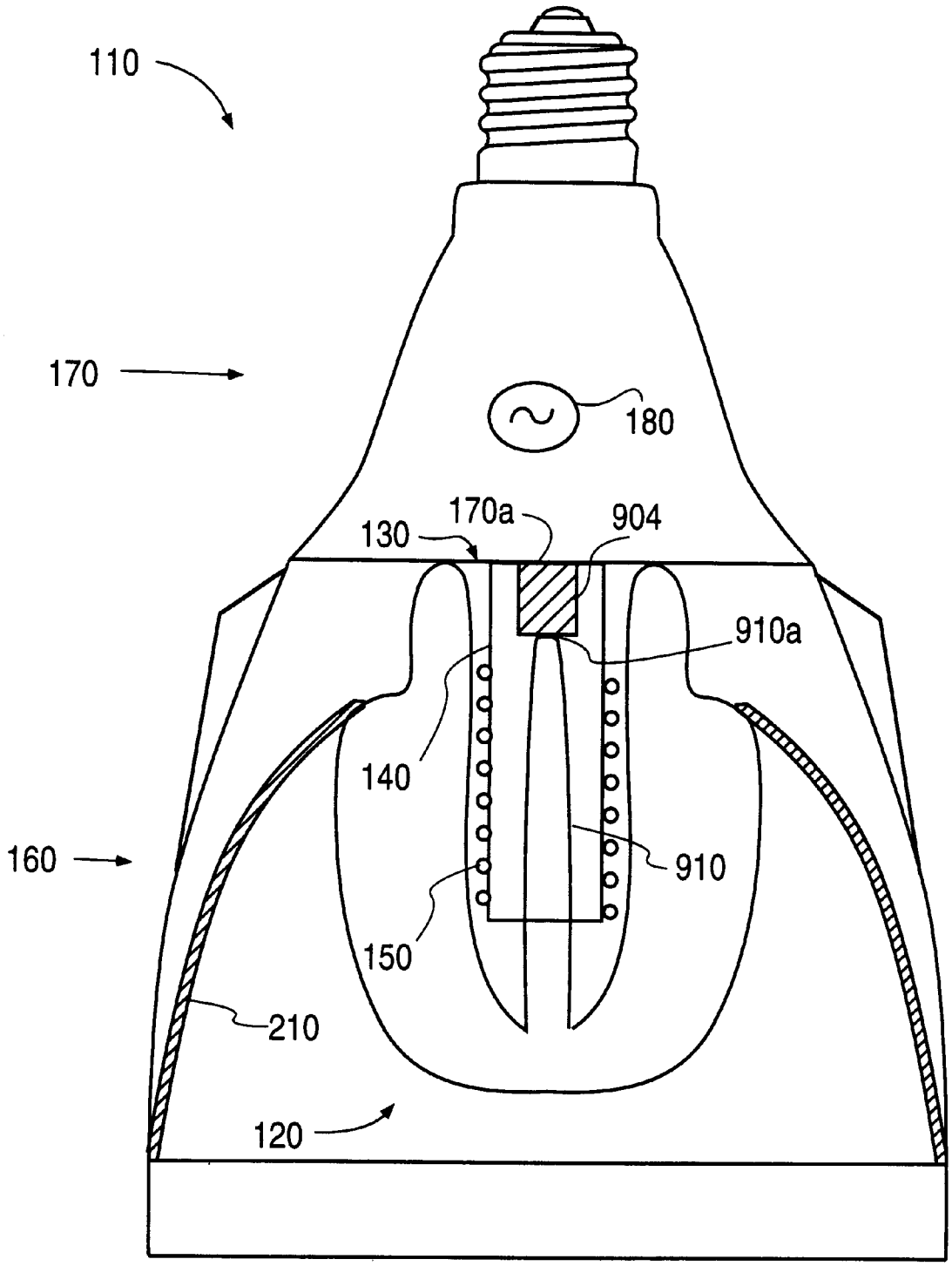
FIG. 7 is a cross section of an electrodeless discharge lamp according to the invention.

If the cold spot temperature in a lamp rises above Tm, it is desirable to cool the light bulb at any spot, and not only at the cold spot, because any cooling lowers the cold spot temperature. In FIG. 7, the envelope of light bulb 120 contains a protuberance 910 inside cavity 130. Protuberance 910 passes through the hollow cylindrical member 140, and the tip 910*a* of protuberance 910 contacts metal heat sink 904. Heat sink 904 is connected to the metal base 170 at metal base portion 170*a*. Heat sink 904 cools tip 910*a* which may or may not contain the cold spot.

Figure 8:
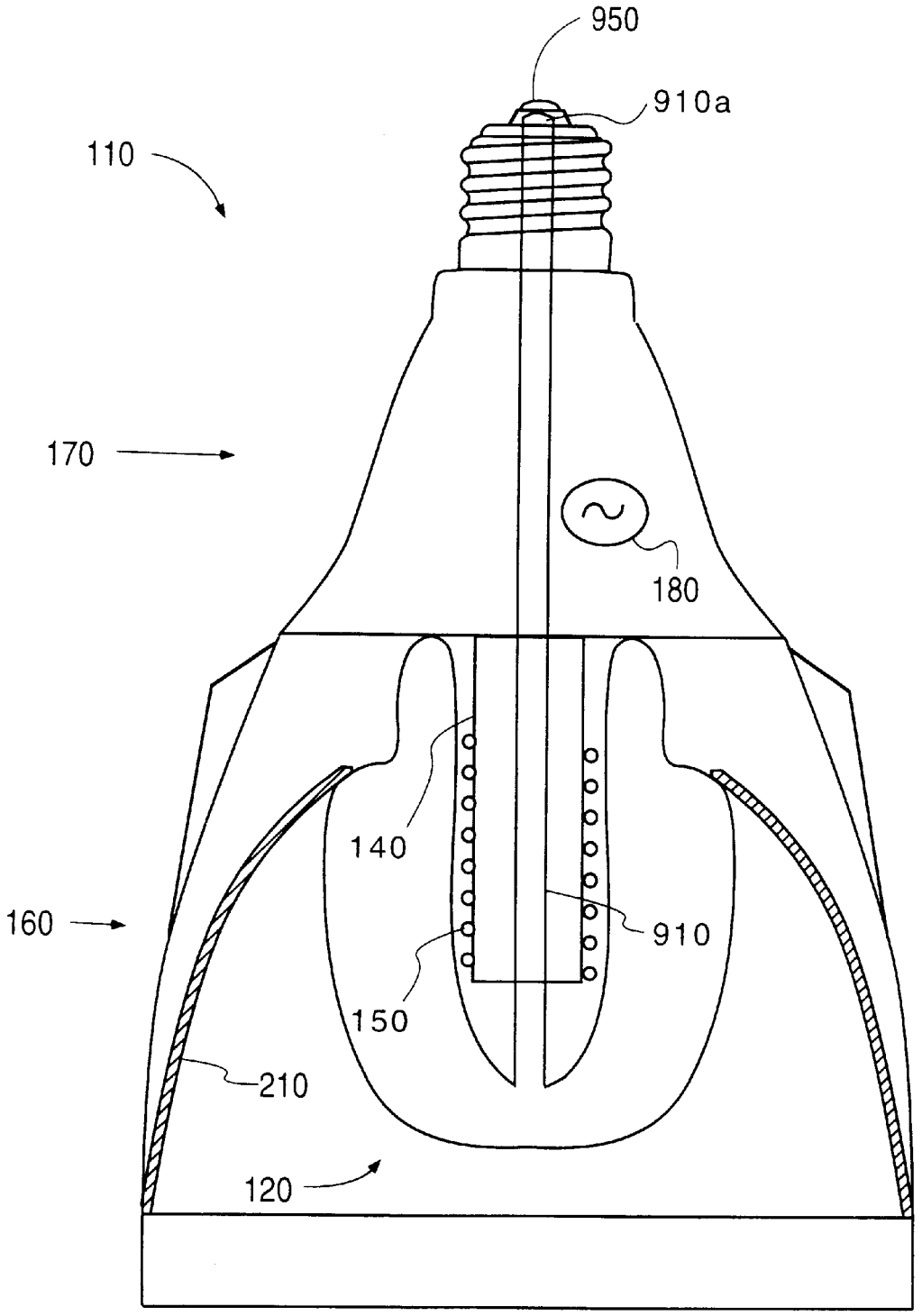
FIG. 8 is a cross section of an electrodeless discharge lamp according to the invention.

In some embodiments (not shown), light bulb 120 of FIG. 7 is provided on the bottom with a protuberance such as protuberance 230 in FIGS. 1 and 2. FIGS. 7 and 8 also show induction coil 150, housing 160, power supply 180, and reflector 210 of lamp 110. FIG. 8 shows light bulb 120 and member 140. FIGS. 7 and 8 also show induction coil 150, housing 160, power supply 180, and reflector 210 of lamp 110. FIG. 8 shows light bulb 120 and member 140.

In FIG. 8, protuberance 910 passes through base 170. Tip 910*a* contacts base contact 950 which in turn contacts one of the two socket contacts (the socket and its contacts are not shown). The wire (not shown) extending from the socket contact which contacts the base contact 950 serves as a heat sink cooling the tip 910*a*.

Figure 9:
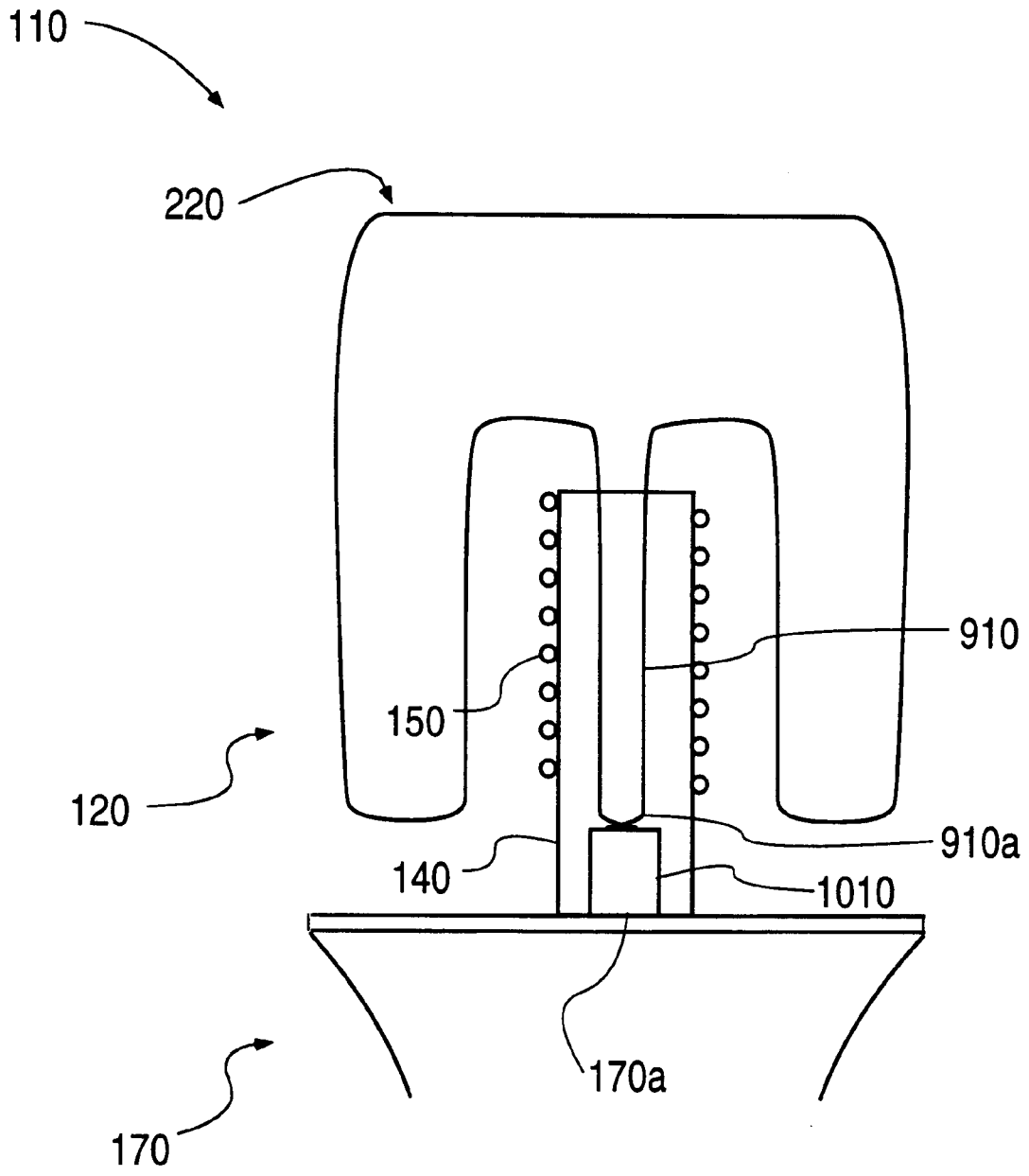
FIG. 9 is a cross section of a portion of an electrodeless discharge lamp according to the invention.

In FIG. 9, lamp 110 includes light bulb 120, cylindrical member 140, induction coil 150 and envelope portion 220. The cold spot temperature is controlled by an active temperature control element 1010 physically contacting the tip 910*a* of protuberance 910 and also contacting the portion 170*a* of base 170. In some embodiments, active element 1010 is a Peltier element such as described generally in R. F. Graf, *Modern Dictionary of Electronics* (6th Ed., Howard W. Sams & Company, 1984, 4th printing 1989), which is incorporated herein by reference, at page 1030 under "thermoelectric couple". In the embodiments in which the active element 1010 is a Peltier element, element 1010 sets a predetermined temperature difference between base portion 170*a* and tip 910*a* so that the temperature at tip 910*a* is a precise amount below the temperature at portion 170*a*. The Peltier element cooling is sufficiently strong in some embodiments to force the cold spot to be located at tip 910*a*. In such embodiments, the cold spot temperature has little sensitivity to the ambient temperature. Indeed, because portion 170*a* is at or near the hottest part of the lamp, the temperature of portion 170*a* has little sensitivity to the ambient temperature. Hence the cold spot temperature at tip 910*a* has little sensitivity to the ambient temperature.

As is known in the art, the temperature difference provided by a Peltier element depends on the current through the element. In one embodiment, element 1010 is a Peltier element that provides a 65° C. temperature difference at the current of 0.8 A. Element 1010 in that embodiment is operated at the current of 200 mA providing the temperature difference of 20° C.

Figure 10:
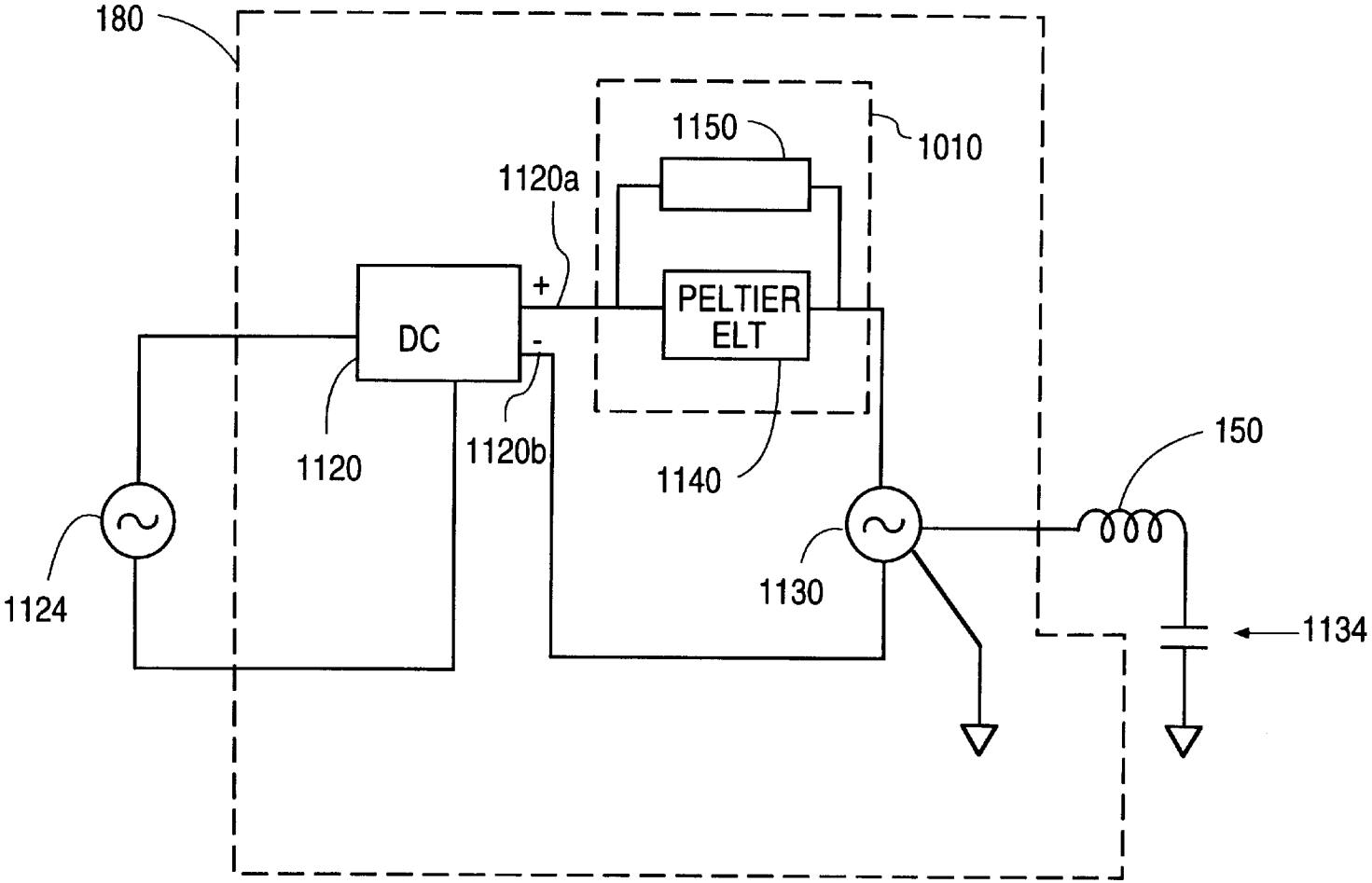
FIG. 10 is a circuit diagram of a circuit in an electrodeless discharge lamp according to the invention.

In some embodiments, the current through the Peltier element is varied depending on the temperature of tip 910*a* so as to further stabilize the cold spot temperature. A circuit diagram of one such embodiment is shown in FIG. 10. Active element 1010, which includes a Peltier element and other circuitry as described below, is wired into power supply 180. Power supply 180 includes a DC generator 1120 whose inputs are connected to standard power supply 1124 provided by a standard socket. One embodiment of DC generator 1120 is described in the aforementioned patent application Ser. No 07/886,718, now abandoned. DC generator 1120 produces a DC voltage on its positive terminal 1120*a* and negative terminal 1120*b*. Negative terminal 1120*b* is connected directly to an input terminal of RF power source 1130 which provides a high frequency current to the induction coil 150. See the aforementioned patent application Ser. No. 07/887,168, now U.S. Pat. No. 5,306,986. Induction coil 150 is coupled to ground through a capacitor 1134. Another input of RF power source 1130 is coupled to the positive terminal 1120*a* through active element 1010.

Active element 1010 includes a Peltier element 1140 and a current control device 1150 connected in parallel. Current control device 1150 senses the temperature at tip 910*a* (FIG. 9) and controls the current through Peltier element 1140 in accordance with the temperature. In one embodiment, current control device 1150 is a temperature sensitive switch which opens if the temperature at tip 910*a* is above Tm. Switch 1150 is closed when the temperature at tip 910*a* is below Tm. When the switch is open, the voltage drop across Peltier element 1140 is 0.6 V in one embodiment, and the current is 200 mA, providing the temperature difference of 200C at the power dissipation of 0.6 V×200 mA=120 mW. The power dissipation of power supply 180 is 150 mW in that embodiment. After the buildup of heat from lamp 110, the cooling by Peltier element 1140 provides a significant gain in the luminous flux. This gain more than compensates the loss of luminous flux due to the 120 mW power dissipation by element 1140.

In another embodiment, current control device 1150 is a temperature sensitive resistor, such as a thermistor, whose resistance increases as the temperature at tip 910*a* rises away from Tm.

Figure 11:
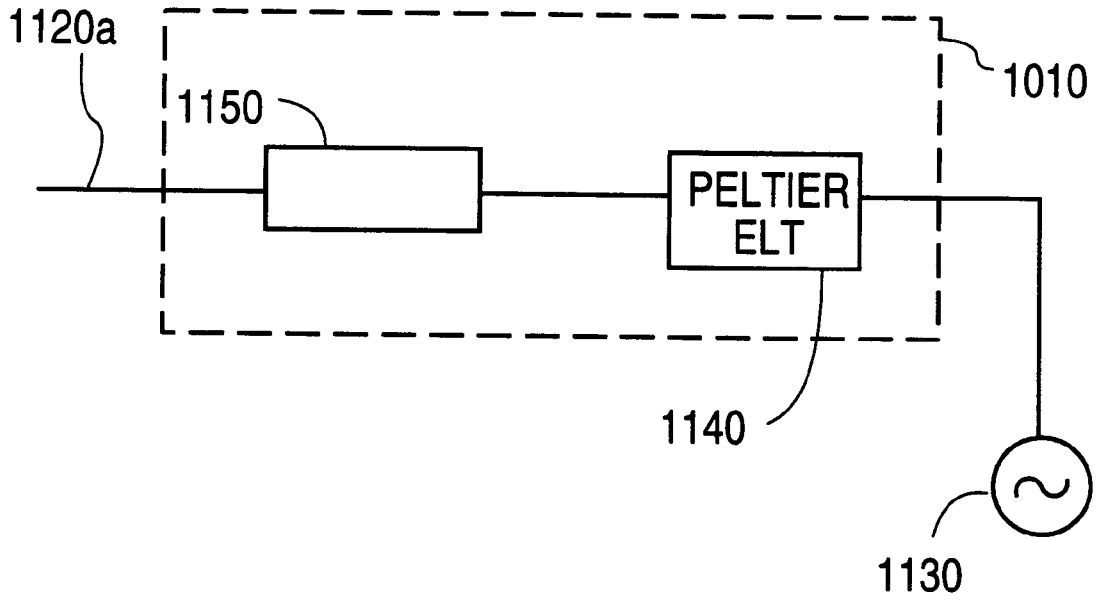
FIG. 11 is a circuit diagram of a circuit in an electrodeless discharge lamp according to the invention.

FIG. 11 shows another embodiment of active element 1010 in which current control device 1150 is connected in series with Peltier element 1140. Current control device 1150 is a thermistor whose resistance decreases as the temperature at tip 910*a* rises away from Tm.

In some embodiments, active element 1010 of a type shown in FIGS. 10 and 11 is connected in parallel with power source 1130 rather than in series as in FIGS. 10 and 11.

In some embodiments, active element 1010 of FIG. 9 heats tip 910*a* when the temperature at tip 910*a* is below Tm. As is known in the art, the Peltier element generates heat if the direction of the current through the Peltier element is reversed. Accordingly, when the temperature at tip 910*a* is below Tm, active element 1010 which contains a Peltier element directs the current through the Peltier element so as to heat tip 910*a*. Whether or not the cold spot is located at tip 910*a* at this stage of operation, the cold spot temperature is at most the temperature at tip 910*a* and hence is below Tm. Hence when active element 1010 heats tip 910*a*, the cold spot temperature also increases and becomes closer to Tm.

When tip 910*a* heats to a certain value which is Tm or above Tm, the current through the Peltier element is reversed and the Peltier element cools tip 910*a*. A precise temperature control is thereby provided. The current switching through the Peltier element is accomplished using switching techniques well known in the art.

The embodiments described above are merely illustrative and do not intend to limit the scope of the invention. For example, some embodiments combine various temperature control techniques of FIGS. 1–11. In particular, active element 1010 is combined with protuberance 230 in some embodiments. Further, the invention is not limited to any particular composition of gas inside the light bulb. In particular, amalgams are used instead of pure mercury in some lamps of the invention. The use of amalgams in prior art fluorescent lamps is described in *OL Induction Lighting*, supra. Advantageously, the cold spot temperature control techniques of the invention, when combined with the amalgams, reduce the mercury pressure control requirements on the amalgam and hence reduce performance problems inherent in the long term use of amalgam lamps. Other embodiments and variations are within the scope of the invention, as defined by the following claims.

What is claimed is:

1. A lamp comprising:

a light bulb having an envelope for containing a substance which when excited causes the light bulb to emit light, the envelope having a cavity defined by an inward extension of the envelope and having a protuberance located at least partially inside the cavity; and an induction coil for exciting the substance inside the light bulb, at least a portion of the induction coil being located in the cavity and surrounding the protuberance but not extending along the whole length of the protuberance.

2. The lamp of claim 1 wherein the entire induction coil is located in the cavity and surrounds the protuberance.

3. The lamp of claim 1 wherein a cold spot of the lamp is located in the protuberance.

4. The lamp of claim 1 wherein the protuberance is partially outside the cavity.

5. The lamp of claim 1 wherein the induction coil is spaced away from the protuberance.

6. The lamp of claim 5 further comprising a member around the protuberance, the member being spaced away from the protuberance, the induction coil being wrapped around or deposited on a surface of the member.

7. The lamp of claim 6 wherein the member is made of a non-conductive, non-magnetic material.

8. The lamp of claim 6 wherein the member is a hollow cylindrical member.

9. The lamp of claim 5 wherein the induction coil is closer to a wall of the cavity than to the protuberance.

10. A lamp comprising:

a light bulb having an envelope for containing a substance which when excited causes the light bulb to emit light, the envelope having a cavity defined by an inward extension of the envelope and a protuberance located at least partially inside the cavity; and an induction coil for exciting the substance inside the light bulb, at least a portion of the induction coil being located inside the cavity and surrounding the protuberance, the induction coil being spaced away from the protuberance, wherein a cold spot of the lamp is located in the protuberance.

11. A lamp comprising:

a light bulb having an envelope for containing a substance which when excited causes the light bulb to emit light, the envelope having a cavity defined by an inward extension of the envelope and a protuberance located at least partially inside the cavity; and an induction coil for exciting the substance inside the light bulb, at least a portion of the induction coil being located inside the cavity and surrounding the protuberance, the induction coil being spaced away from the protuberance, wherein the induction coil does not extend along the whole length of the protuberance.

12. A method for generating light, the method comprising:

providing a light bulb having an envelope containing a substance which when excited causes the light bulb to emit light, the envelope having a cavity defined by an inward extension of the envelope, the envelope having a protuberance located at least partially inside the cavity; and passing a current through an induction coil at least a portion of which is located inside the cavity around the protuberance, wherein the induction coil does not extend along the whole length of the protuberance, the current producing an electric field which ionizes the substance inside the envelope.

13. The method of claim 12 wherein the method includes locating the entire induction coil in the cavity and surrounding the protuberance.

* * * * *